US008763504B2

(12) United States Patent
Tardif

(10) Patent No.: US 8,763,504 B2
(45) Date of Patent: Jul. 1, 2014

(54) BI-DIRECTIONAL FENCE ATTACHMENT FOR A POWER TOOL TABLE

(76) Inventor: Thomas A. Tardif, Laconia, NH (US)

( * ) Notice: Subject to any disclaimer, the term of this patent is extended or adjusted under 35 U.S.C. 154(b) by 65 days.

(21) Appl. No.: 13/371,707

(22) Filed: Feb. 13, 2012

(65) Prior Publication Data

US 2013/0205967 A1 Aug. 15, 2013

(51) Int. Cl.

| | |
|---|---|
| ***B26D 7/06*** | (2006.01) |
| ***B27B 11/02*** | (2006.01) |
| ***B27B 11/04*** | (2006.01) |
| ***B27B 13/10*** | (2006.01) |

(52) U.S. Cl.
USPC ..... 83/441.1; 83/446; 83/438

(58) Field of Classification Search
CPC ..... B27B 25/10; B27B 27/00; B27B 27/02; B27B 27/08; B27B 5/29
USPC ..... 83/446, 447, 435.15–435.19, 438
See application file for complete search history.

(56) References Cited

U.S. PATENT DOCUMENTS

| | | | | |
|---|---|---|---|---|
| 1,651,846 | A | 12/1927 | Stauder | |
| 1,963,688 | A * | 6/1934 | Tautz | 83/438 |
| 2,726,692 | A * | 12/1955 | Collignon | 144/253.1 |
| 2,764,190 | A * | 9/1956 | Howard | 83/438 |
| 2,780,501 | A * | 2/1957 | Rosenberg | 384/47 |
| 4,026,173 | A * | 5/1977 | Livick | 83/421 |
| 4,192,208 | A * | 3/1980 | Munker et al. | 83/438 |
| 4,432,263 | A * | 2/1984 | Kowalchuk | 83/438 |
| 4,481,846 | A * | 11/1984 | Goodell | 83/438 |
| 4,531,438 | A * | 7/1985 | Pair | 83/156 |
| 4,603,612 | A * | 8/1986 | Atkins | 83/425 |
| 4,732,182 | A | 3/1988 | Gorsha | |
| 4,751,865 | A * | 6/1988 | Buckalew | 83/745 |
| 4,817,482 | A | 4/1989 | Dunaway, Jr. et al. | |
| 4,817,693 | A * | 4/1989 | Schuler | 144/359 |
| 5,018,562 | A * | 5/1991 | Adams | 144/253.1 |
| 5,205,198 | A | 4/1993 | Foray et al. | |
| 5,301,726 | A * | 4/1994 | Wojcik | 144/253.2 |
| 5,494,327 | A * | 2/1996 | Derecktor | 296/3 |
| 5,617,909 | A * | 4/1997 | Duginske | 144/253.1 |
| 5,662,019 | A * | 9/1997 | Denman | 83/425 |
| 5,768,966 | A * | 6/1998 | Duginske | 83/468.7 |
| 5,809,631 | A * | 9/1998 | Poulin | 29/560 |
| 5,931,208 | A * | 8/1999 | Gifkins | 144/145.2 |
| 6,095,024 | A * | 8/2000 | Brutscher et al. | 83/35 |

(Continued)

FOREIGN PATENT DOCUMENTS

EP 2156930 A2 * 2/2010

*Primary Examiner* — Ghassem Alie
*Assistant Examiner* — Bharat C Patel
(74) *Attorney, Agent, or Firm* — Robert R. Deleault, Esq.; Mesmer & Deleault, PLLC

(57) ABSTRACT

A fence attachment apparatus for a table power tool equipped with an existing rip fence has a longitudinal member that includes a first side member having a top surface, a bottom surface, a cutting-side lateral surface, and a fence-side lateral surface. The longitudinal member has a bridge member that extends transversely from the first side member and connects to the first side member along a major portion of the first side member adjacent to the top surface. The fence attachment has a sliding member in sliding engagement with the top surface of the longitudinal member, where the sliding member has a top sliding surface and a bottom sliding surface. A slide mechanism is disposed between the bottom sliding surface of the sliding member and the top surface of the longitudinal member, where the slide mechanism provides longitudinal movement to the sliding member.

17 Claims, 9 Drawing Sheets

(56) References Cited

U.S. PATENT DOCUMENTS

| | | | | |
|---|---|---|---|---|
| 6,123,173 | A * | 9/2000 | Patros | 182/181.1 |
| 6,588,468 | B1 * | 7/2003 | Tucker et al. | 144/372 |
| 6,619,347 | B2 * | 9/2003 | Jukoff et al. | 144/253.6 |
| 7,036,414 | B2 * | 5/2006 | Behne et al. | 83/468.7 |
| 7,127,976 | B1 * | 10/2006 | Fitzsimmons | 83/435.11 |
| 7,140,286 | B2 * | 11/2006 | Schwartz | 83/446 |
| 7,174,820 | B2 * | 2/2007 | Huang | 83/446 |
| 7,263,922 | B2 * | 9/2007 | Hewitt et al. | 83/438 |
| 7,614,329 | B2 * | 11/2009 | Aigner | 83/437.2 |
| 8,234,959 | B2 * | 8/2012 | Janson | 83/438 |
| 2004/0226425 | A1 * | 11/2004 | Hewitt et al. | 83/446 |
| 2005/0139056 | A1 * | 6/2005 | Gass et al. | 83/438 |
| 2006/0011033 | A1 * | 1/2006 | Rossetti et al. | 83/471.3 |
| 2006/0042443 | A1 * | 3/2006 | Shibata | 83/477.2 |
| 2006/0117573 | A1 * | 6/2006 | Jensen et al. | 30/286 |
| 2006/0144203 | A1 * | 7/2006 | Behne et al. | 83/446 |
| 2007/0048142 | A1 * | 3/2007 | Dambrine et al. | 416/219 R |
| 2008/0053284 | A1 * | 3/2008 | Miller et al. | 83/446 |
| 2008/0127794 | A1 * | 6/2008 | Jaksha | 83/409 |
| 2008/0236355 | A1 * | 10/2008 | Gass et al. | 83/438 |
| 2008/0257124 | A1 * | 10/2008 | Yu | 83/438 |
| 2010/0043614 | A1 * | 2/2010 | Gehret et al. | 83/471.3 |
| 2011/0192497 | A1 * | 8/2011 | Clark | 144/371 |

* cited by examiner

BI-DIRECTIONAL FENCE ATTACHMENT FOR A POWER TOOL TABLE

BACKGROUND OF THE INVENTION

1. Field of the Invention

The present invention relates generally to devices for positioning and feeding a workpiece into a cutting surface. More specifically the present invention relates to an attachment for a rip fence used with a power tool table.

2. Description of the Prior Art

Table saws, routers, and shaping tools are commonly used to cut or shape a workpiece. The workpiece is commonly a piece of wood being fed along a rip fence into a table saw or router. The rip fence may be a longitudinal block of wood, metal, or other material that is positioned parallel to the feed direction of the workpiece and at a fixed lateral distance from the cutting element. The rip fence is usually secured in position by selectively locking to a guide along the front of the tool, for example, so that the operator may feed the workpiece into the cutting element for cuts at a consistent, fixed lateral distance from the cutting element.

Others have designed devices that attach to a rip fence for guiding or supporting a workpiece. For example, one work-holding apparatus for a power tool table has a rip fence aligned parallel to the direction of work feed. The apparatus uses a track mounted to the side of the rip fence. The apparatus also has a clamping frame slidably mounted to the track against which the workpiece is clamped against the clamping frame so that an operator can feed the workpiece into the cutting element of the power tool. A sliding track slides relative to the mounted track.

In another design, a workpiece guide is dimensioned to fit over a table saw fence. The guide has an elongated inverted U-shaped body with a first leg angled inwardly to aid in a snug fit with the fence. The second leg of the body has a horizontal lip at its lower extremity which rests flat against the table top saw surface during use. A guide strip extends along the second leg. A thin workpiece is held in steady position during a cutting operation by passing the workpiece between the guide strip and the lip.

SUMMARY OF THE INVENTION

Because other designs have a track mounted to the side of an existing fence, the user must modify the tool's rip fence to install the device. With one design, the user screws a track to the side of the existing rip fence, which requires drilling holes into the rip fence. Also, when the user presses on the tool attached to the track on the side of the rip fence, the user applies torque to the rip fence, which compromises the stability and accuracy of the fence. Further, tracks mounted to the side surface of a rip fence result in uneven wear of moving parts because the parts are biased downward due to gravity and pressure from the user.

Other designs are merely intended as a stationary guide for thin sheet materials, for example, and do not enable longitudinal movement of a sliding member along the top surface of the existing fence.

Therefore, what is needed is a bi-directional fence for power tool tables that is attachable to an existing rip fence, has a sliding member that moves longitudinally along the top surface of the fence attachment, and that is capable of receiving push tools and workpiece supports.

It is an object of the present invention to provide a sliding fence for use with tool attachments.

It is another object of the present invention to improve safety for the operator by enabling one to remove hands and fingers away from immediate proximity to saw blades or shaper knives.

The present invention achieves these and other objectives by providing a bi-directional fence attachment for a power tool table that does not require modification of the existing rip fence and that permits a workpiece coupled to the fence attachment to be moved into the cutting device of the power tool.

In one embodiment of the present invention, a fence attachment apparatus has a longitudinal member comprising a first side member having a top surface, a bottom surface, a cutting-side lateral surface, and a fence-side lateral surface. The apparatus has a bridge member connected to the first side member adjacent the top surface and extending along a major portion of the first side member. The bridge member has a top surface with a width that extends transversely a pre-defined distance to a distal side away from the fence-side lateral surface of the first side member. A sliding member is in sliding engagement with the top surface of the longitudinal member. The sliding member has a top sliding surface and a bottom sliding surface. A slide mechanism is disposed between the bottom sliding surface of the sliding member and the top surface of the longitudinal member. The slide mechanism is configured for providing longitudinal movement of the sliding member relative to the longitudinal member.

In another embodiment of the present invention, the longitudinal member has a second side member substantially parallel to the first side member. The second side member has a fence-side lateral surface and is configured to be connected adjacent to the distal side of the bridge member. The longitudinal member substantially forms an inverted-U shape configured to receive the existing rip fence.

In another embodiment of the present invention, the longitudinal member has a sacrificial member on the cutting-side lateral surface of the first side member to enable the user to replace the sacrificial member if it becomes damaged or worn.

In another embodiment of the present invention, the longitudinal member has a sacrificial member on an opening portion of the bottom surface of the first side member to enable the user to replace the sacrificial member if it becomes damaged or worn.

In another embodiment of the present invention, the first side member has a recess to accommodate a cutting element of the power tool. The recess extends at least partially into the body portion of the first side member. The recess may also be a through-opening.

In another embodiment of the present invention, the slide mechanism is a plurality of surfaces having a coefficient of friction of 1.5 or less for longitudinal movement between the sliding member and the longitudinal member, a mortise and tenon combination, a pair of mating sliding tracks each having a web and sidewalls, a tongue and groove combination, a wheel and a slot, or a plurality of rollers disposed between the sliding member and the longitudinal member.

In another embodiment of the present invention, one portion of the slide mechanism is on the top surface of the longitudinal member and a second portion of the slide mechanism is on the bottom sliding surface of the sliding member.

In another embodiment of the present invention, at least one of the combination of a plurality of surfaces having a coefficient of friction of 1.5 or less is polytetrafluoroethylene (PTFE). In another embodiment of the present invention, the coefficient of friction is 0.5 or less. In another embodiment of the present invention, the coefficient of friction is 0.1 or less.

In another embodiment of the present invention, the apparatus includes a mounting member attached to the top sliding surface of the sliding member.

In another embodiment of the present invention the top surface of the sliding member includes a longitudinal channel parallel and adjacent to the cutting-side lateral surface of the sliding member.

In another embodiment of the present invention, the first side member and the bridge member comprise a unitary structure. In another embodiment of the present invention, the longitudinal member comprises a unitary structure.

In another embodiment of the present invention, the top surface of the bridge member is coplanar with the top surface of the first side member.

In another embodiment of the present invention, the apparatus includes a shield attached to one of the sliding member and the longitudinal member.

In another embodiment of the present invention, the apparatus includes a securing element configured to draw first longitudinal side member towards the second longitudinal side member for securing the fence attachment to the existing rip fence.

In another embodiment of the present invention, the apparatus includes a work tool accessory.

DETAILED DESCRIPTION OF THE PREFERRED EMBODIMENT

Figure 1:
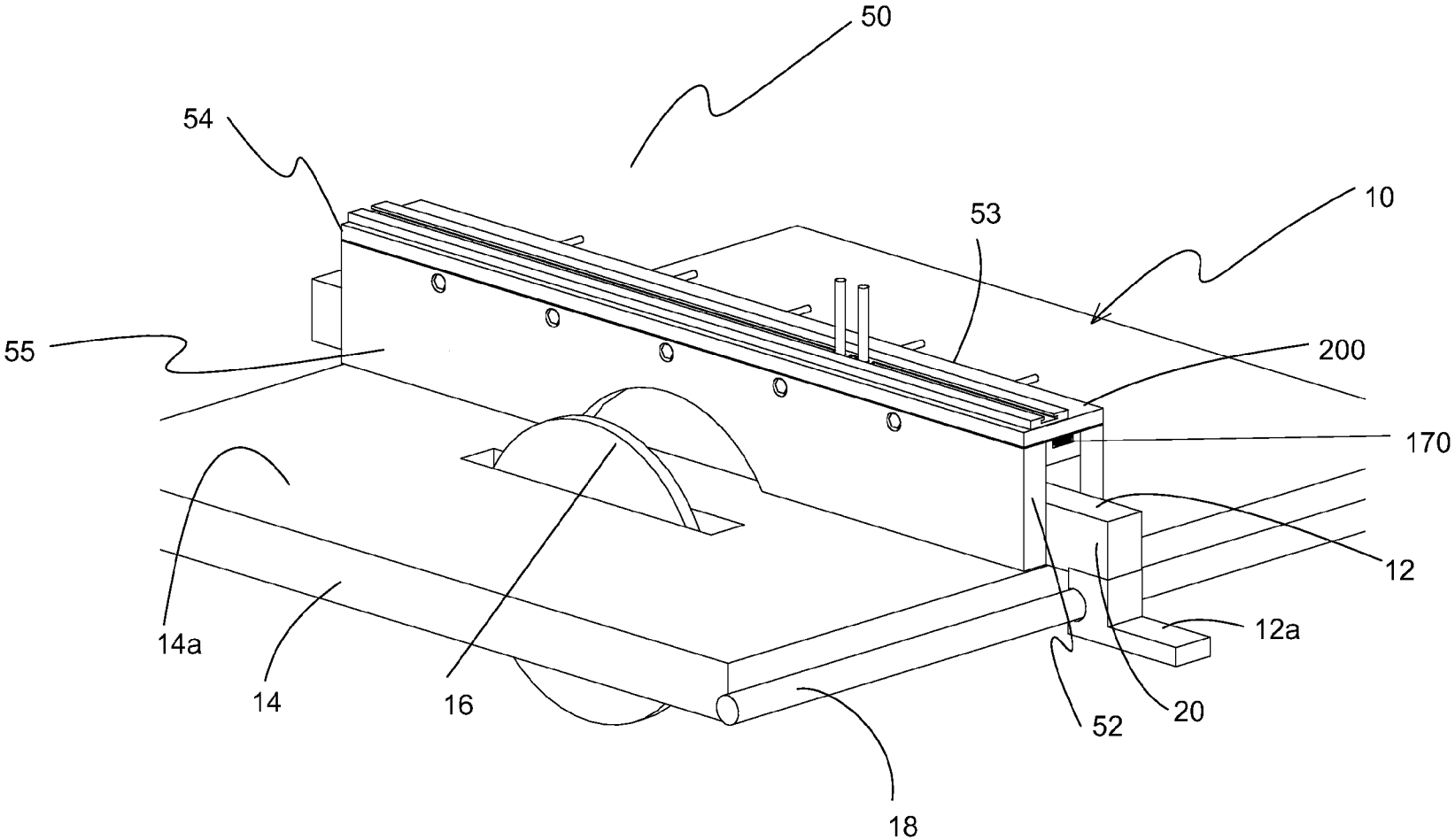
FIG. 1 is a perspective view of one embodiment of the present invention showing a fence attachment apparatus installed on a power tool table.

The preferred embodiments of the present invention are illustrated in FIGS. 1-10. FIG. 1 shows one embodiment of a bi-directional fence attachment 50 of the present invention for use with power tool 10 having a table 14. Fence attachment 50 has a longitudinal member 55, a sliding member 200, and a sliding mechanism 170. Fence attachment 50 is configured to slip over or attach to an existing fence 12 of table 14 and preferably rests on a top surface 14*a*. Fence attachment 50 has a proximal end 52 nearest the feed-side of table 14 and a distal end 54 nearest the outrun side of table 14.

Power tool 10 has cutting element 16 that passes through top surface 14*a* of table 14. Cutting element 16 may be a saw blade, shaping knife, router bit, and the like. Power tool 10 also has bar 18 to which a fence lock 12*a* of rip fence 12 is attached and along which rip fence 12 may be adjusted in a horizontal position parallel to cutting element 16.

Figure 2:
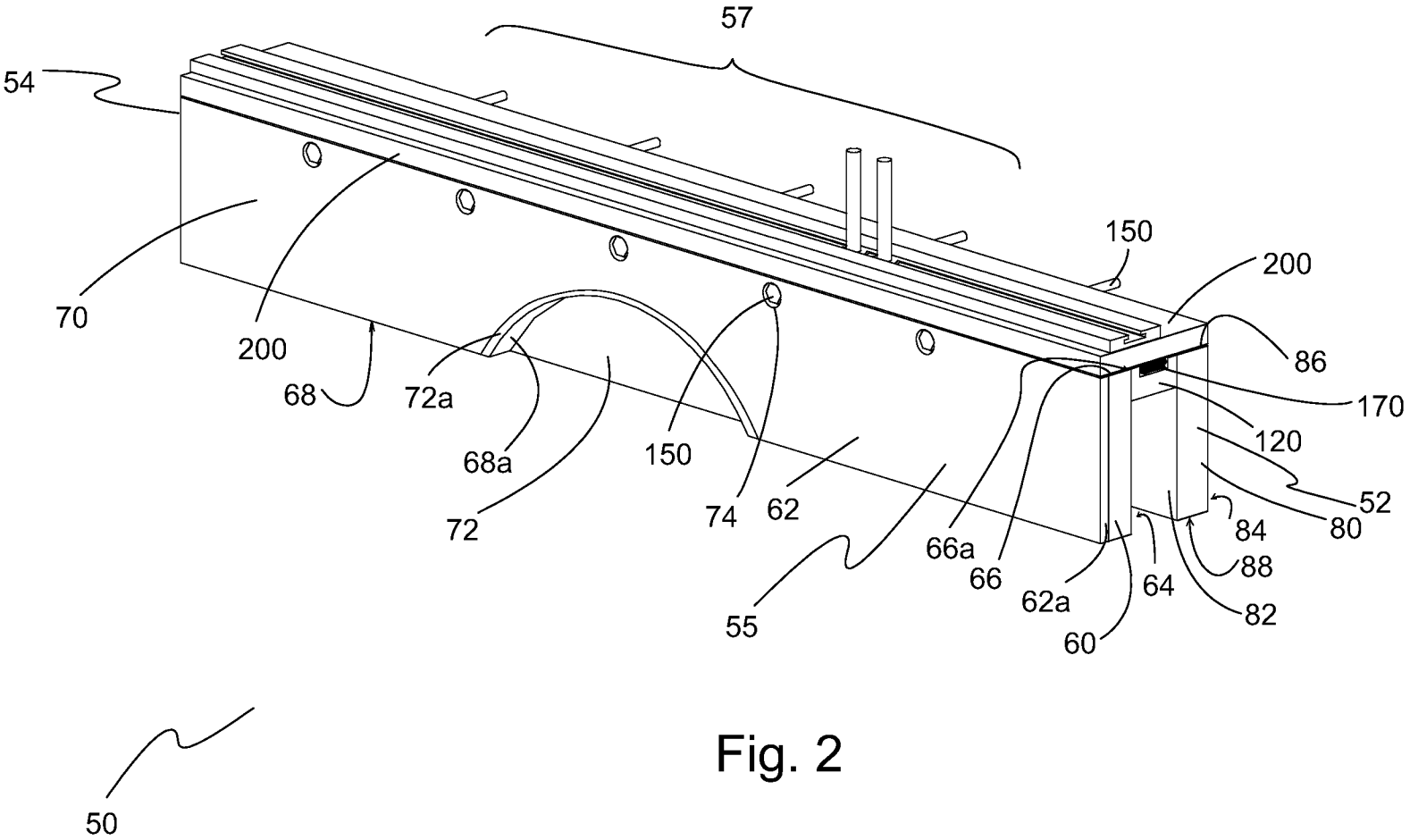
FIG. 2 is a perspective view of the fence attachment of the present invention as shown in FIG. 1.

FIG. 2 shows a perspective view of one embodiment of fence attachment 50. Attachment 50 has longitudinal member 55 with a first side member 60, a second side member 80, a bridge member 120, a sliding member 200, and a slide mechanism 170. Although FIG. 2 shows side member 80, it is contemplated that first bridge member 120 may be unitary with side member 60 and not include second side member 80. In such an embodiment, longitudinal member 55 may be secured to rip fence 12 by clamping first side member 60 to rip fence 12 in one or more locations. In another embodiment, a flange or catch on bridge member 120 may engage the outside lateral surface 20' of rip fence 12 to secure longitudinal member 55 along rip fence 12.

First side member 60 has a cutting-side surface 62, a fence-side surface 64 (not visible), a top surface 66, a bottom surface 68, and a body portion 70. Cutting-side surface 62 is the lateral (i.e., side) surface of first side member 60 that is nearest to, or faces, cutting element 16 (not shown). Fence-side surface 64 is the lateral surface of first side member 60 that contacts a cutting-side lateral surface 20 of rip fence 12 (shown in FIG. 1). Bottom surface 68 preferably rests upon table surface 14*a*, but does not have to do so. Top surface 66 of first side member 60 is preferably co-planar with top surface 86 of second side member 80 and/or a top surface 122 (more clearly shown in FIG. 3) of bridge member 120.

In embodiments where longitudinal member 55 does not have second side member 80, longitudinal member 55 may be retained against rip fence 12 with clamps, brackets, and the like, or by interaction with second side member 80 (discussed below). For example, one or more fasteners 150 may pass through first side member 60 to engage a bracket, which in turn engages the outside lateral surface 20' of rip fence 12, thereby securing fence attachment 50 in position against rip fence 12. In another example, the user may position one or more clamps against cutting-side surface 62 of first side member 60 and outside surface 20' of rip fence 12 to secure fence attachment 50 to rip fence 12.

First side member 60 preferably has recess 72 formed in cutting-side surface 62 and extending upward into body portion 70 from bottom surface 68. The term "body portion" refers generally to the bulk material of first side member 60 and second side member 80 that occupies the volume enclosed by the outside surfaces of first side member 60 and second side member 80. Recess 72 accommodates cutting element 16, which may be a saw blade, shaping knife, router bit, or the like to prevent cutting element 16 from contacting fence attachment 50 during use. Recess 72 may be curved similar to the shape of the portion of a saw blade that extends through the top surface 14*a* of table 14. Alternately, recess 72 may have a rectangular or other shape to accommodate cutting element 16. Recess 72 may extend partially or completely through first side member 60 from cutting-side surface 62 towards fence-side surface 64.

In some embodiments, first side member 60 includes an optional sacrificial member 62*a* on cutting-side surface 62 of first side member 60. Recess 72 may also have an optional sacrificial surface 72*a* on a cavity portion 68*a* of bottom surface 68. Sacrificial members 62*a* and/or 72*a* are removable and replaceable parts of first side member 60. If a user unintentionally brings the fence attachment 50 into contact with cutting element 16, causing damage, the damaged sacrificial member 62*a* and/or 72*a* may be replaced without the need to replace the entire first side member 60 or fence attachment 50.

In one embodiment, sliding member 200 is preferably a relatively flat, rectangular-shaped piece that preferably extends laterally from the cutting-side surface 62 of first side member 60 to at least an outside lateral surface 20' of fence 12 (not shown). Sliding member 200 is preferably substantially equal in length to first longitudinal member 60 from the proximal end 52 to the distal end 54 to provide added stability against inadvertent torque applied to the workpiece and transferred to fence attachment 50 as the workpiece is moved into cutting element 16. The increased length of sliding member 200 also provides more flexibility to the user for positioning attachments and for use with larger workpieces. Although shown as extending from proximal end 52 to distal end 54, sliding member 200 may be shorter than first side member 60.

First side member 60 may be retained against cutting-side lateral surface 20 of rip fence 12 by using fasteners, brackets, clamps, and the like. In other embodiments, first side member 60 is retained in position with additional portions of longitudinal member 55 as discussed below.

In some embodiments, attachment 50 has a second side member 80 that has a fence-side surface 82, an outside surface 84 (not visible), a top surface 86, a bottom surface 88, and a body portion 90 (not shown). Second side member 80 extends substantially parallel to first longitudinal member 60 along outside lateral surface 20' (not shown) of rip fence 12 (not shown). Second side member 80 preferably is the same length as first side member 60 from the proximal end 52 to the distal end 54 of fence attachment 50. Second side member 80, however, may optionally be a different length than first side member 60 and also may comprise more than one piece.

In some embodiments, one or more optional securing elements 150 (e.g., fasteners) pass through openings 74 in first side member 60 and second side member 80 to retain side members 60, 80 against opposite lateral sides 20, 20' of rip fence 12. Each securing element 150 may engage the fence-side surfaces 64, 82 and/or outer surfaces 62, 84 of fence attachment 50. Securing element 150 may be any one or a combination of a screw, bolt, nail, clamp, double-ended threaded rod, a double-ended bolt with right and left-hand threads, a bracket, catch, turnbuckle, and the like along with any necessary fastening components such as nuts, washers, threaded recesses, etc.

For example, a threaded bolt or machine screw 150 may pass through second side member 80, over rip fence 12, and into a threaded recess (not shown) located on first side member 60. As machine screw 150 is tightened, side members 60, 80 are drawn together to engage the lateral sides 20, 20' of rip fence 12, thereby securely holding fence attachment 50 to rip fence 12. As another example, a screw may extend through opening 74 in first longitudinal member 60 into a threaded recess (not shown) in second side member 80 to draw the two members 60, 80 tightly against respective lateral sides 20, 20' of rip fence 12.

Second side member 80 may be a single piece or may comprise a plurality of blocks, wedges, plates, and the like through which securing element 150 (e.g., a fastener) may pass to retain first side member 60 and each second side member 80 against lateral sides 20, 20' of rip fence 12. Preferably, each second side member 80 is substantially identical in height to first side member 60. Having substantially the same height improves stability to fence attachment 50 and creates a planar top surface 66*a* of longitudinal member 55 across the top surfaces 66, 86 of first side member 60 and second side member(s) 80.

Figure 3:
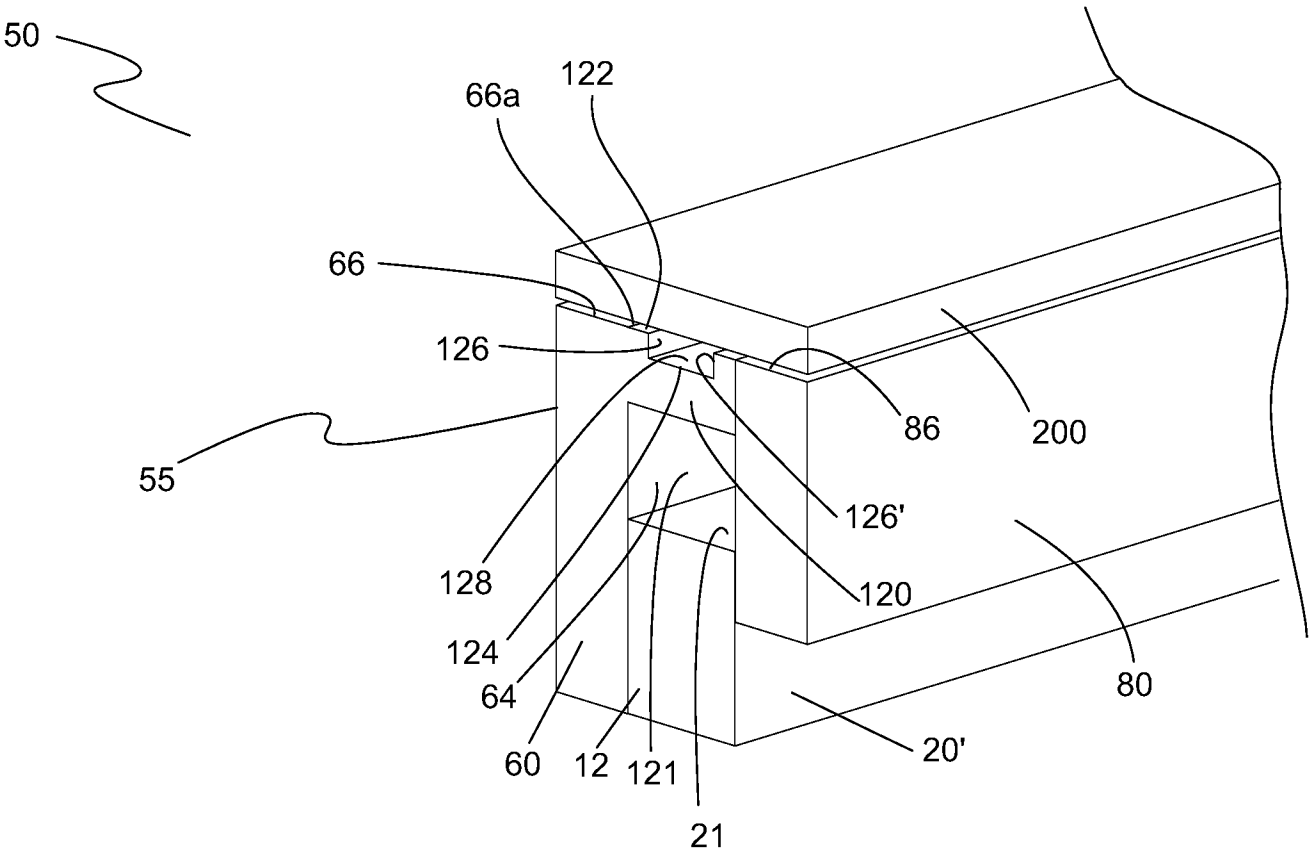
FIG. 3 is an enlarged, perspective view of the proximal end of one embodiment of the fence attachment of the present invention showing the relationship between the fence attachment and a simplified version of an existing fence.

Referring to FIGS. 2 and 3, for example, one embodiment of fence attachment 50 includes bridge member 120 extending along a major portion 57 of longitudinal member 55. Major portion 57 is defined as at least the majority of first side member 60 between proximal end 52 and distal end 54. Preferably, bridge member 120 extends along the entire length of first side member 60 from proximal end 52 to distal end 54. Bridge member 120 has a top surface 122 with a width that extends transversely a pre-defined distance from first side member 60 to a distal side 53 away from fence-side lateral surface 64 of first side member 60. Bridge member 120 may be positioned between first side member 60 and second side member 80 as shown in FIG. 2. Alternately, bridge member 120 may extend laterally from first side member 60 towards second side member 80 as shown in FIG. 3. In a configuration as shown in FIG. 3, bridge member 120 may terminate at or intersect fence-side surface 82 of second side member 80. Alternately, bridge member 120 may extend over top surface 86 of a shorter second side member 80. When configured in a coplanar arrangement, top surface 66 of first side member 60, top surface 122 of bridge member 120, and/or top surface 86 of second side member 80 comprise top surface 66*a* of longitudinal member.

Bridge member 120 has a top surface 122 and preferably has substantially the same overall width as rip fence 12 to enable orthogonal orientation between bridge member 120 and each of side members 60, 80 when fence attachment 50 is secured to rip fence 12. Securing elements 150 (e.g., fasteners) (not shown) preferably pass through first side member 60, through bridge member 120, and through second side member 80 to maintain the vertical and longitudinal positions of bridge member 120. Securing elements 150 may alternately pass through the void 121 between fence 12 and bridge member 120. Nuts secured onto the end of fastener 150 are tightened to squeeze side members 60, 80 against rip fence 12 and bridge member 120.

Various combinations of first side member 60, second side member 80, and bridge member 120 may be arranged and configured to substantially form an inverted-U shaped longitudinal member 55 that has a void 121 to receive existing rip fence 12. For example, bridge member 120 may be between side members 60, 80, or bridge member 120 may be positioned above one or both side members 60, 80. The top surface 122 of bridge member 120 may be coplanar with one or both top surface(s) 66, 86 of side members 60, 80, respectively; alternately, top surface 122 of bridge member 120 may be above or below one or both of top surfaces 66, 86 of side members 60, 80.

As shown in FIG. 3, for example, some embodiments of fence attachment 50 have first side member 60 and bridge member 120 comprising a unitary structure. In this unitary structure, bridge member 120 is a shelf-like extension from first side member 60. Together, top surface 66 of first side member and top surface 122 of bridge member 120 may form top surface 66*a* of longitudinal member 55 that is wider than the distance between cutting-side surface 62 and fence-side surface 64 of longitudinal member 60. In other embodiments, first side member 60, second side member 80, and bridge member 120, respectively, comprise a unitary longitudinal member 55 with a planar top surface 66*a* formed with top surfaces 66, 86, 122, respectively.

In one embodiment as shown in FIG. 3, longitudinal member 55 has an inverted-L shape with fence-side surface 64 extending vertically against lateral surface 20 of rip fence 12 and bridge member 120 extending horizontally above top surface 21 of rip fence 12 towards second side member 80. Second side member 80 preferably is substantially identical in height to first side member 60. In some embodiments, second side member 80 is shorter vertically than first side member 60 as shown in FIG. 3.

Figure 4:
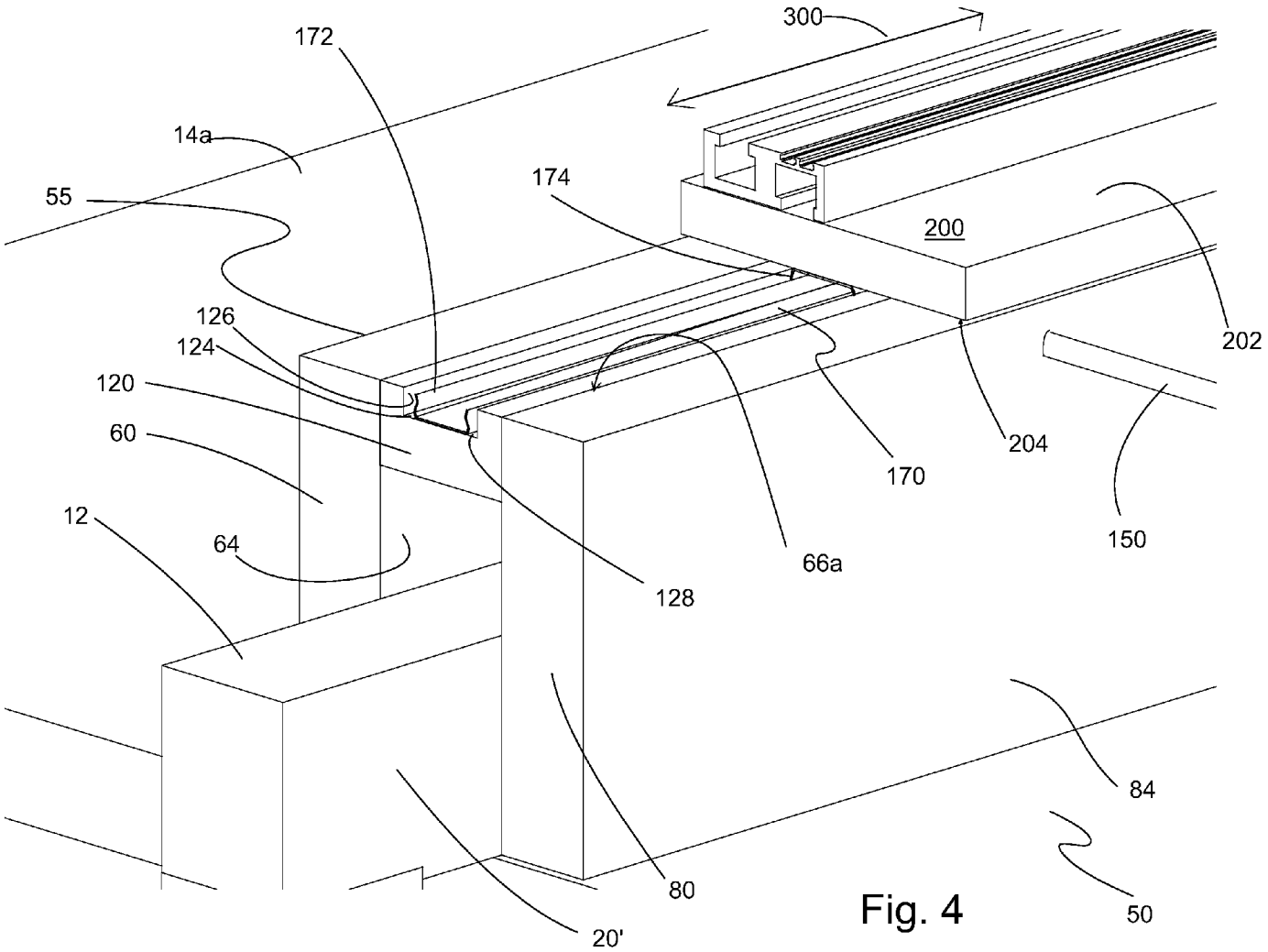
FIG. 4 is an enlarged, front perspective view of the fence attachment of the present invention showing a slide mechanism disposed between the slide member and the longitudinal member and the sliding member positioned towards the distal end of the fence attachment.

Referring to FIG. 4, slide mechanism 170 is disposed between sliding member 200 and longitudinal member 55. One part of slide mechanism 170 is fixedly attached within a longitudinal slot 124 formed in top surface 66*a* of longitudinal member 55. Another part of slide mechanism 170 is fixedly attached to bottom surface 204 of sliding member 200.

As shown in FIGS. 3 and 4, some embodiments of bridge member 120 have a longitudinal slot 124 with slot walls 126, 126' and slot surface 128. Longitudinal slot 124 preferably extends along the length of longitudinal member 55. Optionally, slot 124 extends along a major portion of longitudinal member 55.

FIG. 4 illustrates a proximal perspective view of one embodiment of fence attachment 50 in a distally-extended position and showing outside surface 84 of second side member 80. Bridge member 120 is positioned between longitudinal members 60, 80, located over the top surface 21 of existing rip fence 12, and is approximately the same width as existing rip fence 12 as measured from cutting-side lateral surface 20 to outside lateral surface 20'.

As shown in FIG. 4, slot 124 may be used to accept one part of a two-part sliding track to enable longitudinal sliding member 200 to move parallel to rip fence 12 along top surface 66*a* of longitudinal member 55. For example, slide mechanism 170 in one embodiment of the fence attachment 50 is a telescoping drawer slide as is known in the art. Sliding mechanism 170 enables sliding member 200 to slide longitudinally as indicated by an arrow 300.

A first part 172 of slide mechanism 170 is attached to slot surface 128, to top surface 122 of bridge member 120, and/or to top surface 66 of first side member 60; another or second part 174 of slide mechanism 170 attaches to bottom surface 204 of sliding member 200. A slot in the bottom surface 204 of sliding member 200 and/or in the top surface 66*a* of longitudinal member 55 enables sliding member 200 to be positioned with the desired distance between bottom surface 204 of sliding member 200 and top surface 66*a* of longitudinal member 55. In other embodiments, the vertical position of bridge member 120 may be adjusted with respect to first side member 60 to provide the desired distance between bottom surface 204 of sliding member 200 and top surface 66*a* of longitudinal member 55.

Slide mechanism 170 may be a mortise and tenon combination, a multi-part track, a tongue and groove combination, a plurality of rollers disposed between sliding member 200 and longitudinal member 55, a wheel and slot combination, or other devices. Preferably, low-friction materials or coatings are used on mating surfaces of slide mechanism 170 for mortise and tenon or tongue and groove combinations. For example, polytetrafluoroethylene (PTFE) has a coefficient of friction of approximately 0.04. In contrast, aluminum sliding against aluminum has a coefficient of friction of about 1.5. A coefficient of friction, $\mu$, preferably has a value of about 1.5 or below, more preferably about 0.5 or below, and most preferably below 0.1. Other combinations of materials may be used to achieve the desired coefficient of friction, including metals (steel, aluminum, copper, cast iron, zinc, etc.), plastics (nylon, PTFE, etc.), ceramics and ceramic coatings, graphite-filled polymers, and other materials.

Figure 5A:
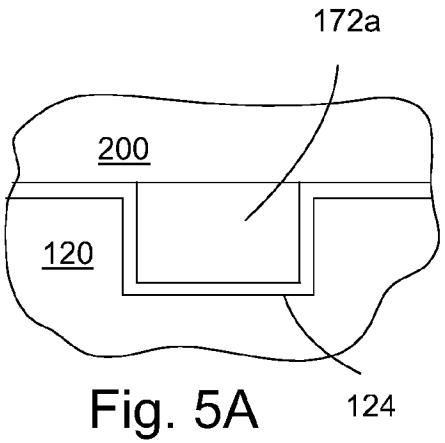
FIGS. 5, 5A and 5B are cross-sectional views of three embodiments of a slide mechanism of the present invention showing a track and rail combination, a tongue and groove combination, and wheel and slot combination.
Figure 5:
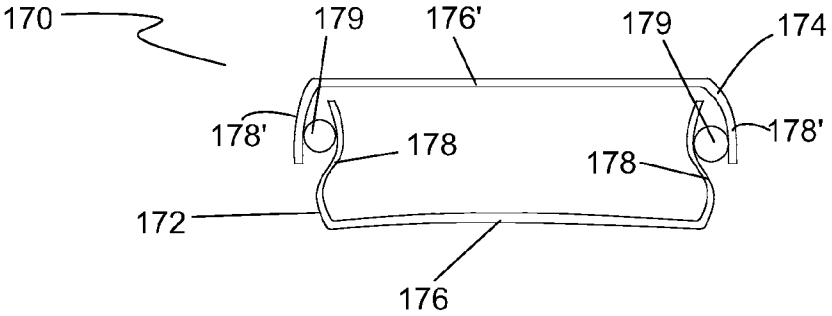
Figure 5B:
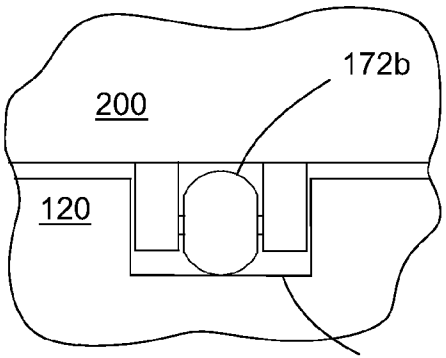

Referring to FIG. 5, one embodiment slide of mechanism 170 has a pair of generally U-shaped tracks 172, 174. Track 172 has a web 176 and side rails 178, while track 174 has corresponding web 176' and side rails 178'. A plurality of optional rollers 179 (e.g., ball bearings) may be incorporated between opposed side rails 178, 178' to facilitate movement of sliding member 200 relative to longitudinal member 55. One of the pair of mating tracks 172, 174 is disposed on longitudinal member 55; the other of the pair of mating tracks tracks 172, 174 is disposed on sliding member 200. FIGS. 5A and 5B show alternative tongue and groove combination and wheel and slot combination, respectively. In FIG. 5A, slot 124 is the groove while a tongue 172*a* is attached to bottom surface 204. In FIG. 5B, slot 124 is the slot of the wheel and slot combination while a plurality of wheels 172*b* are connected to bottom surface 204 and roll against the slot surface 128.

Figure 6:
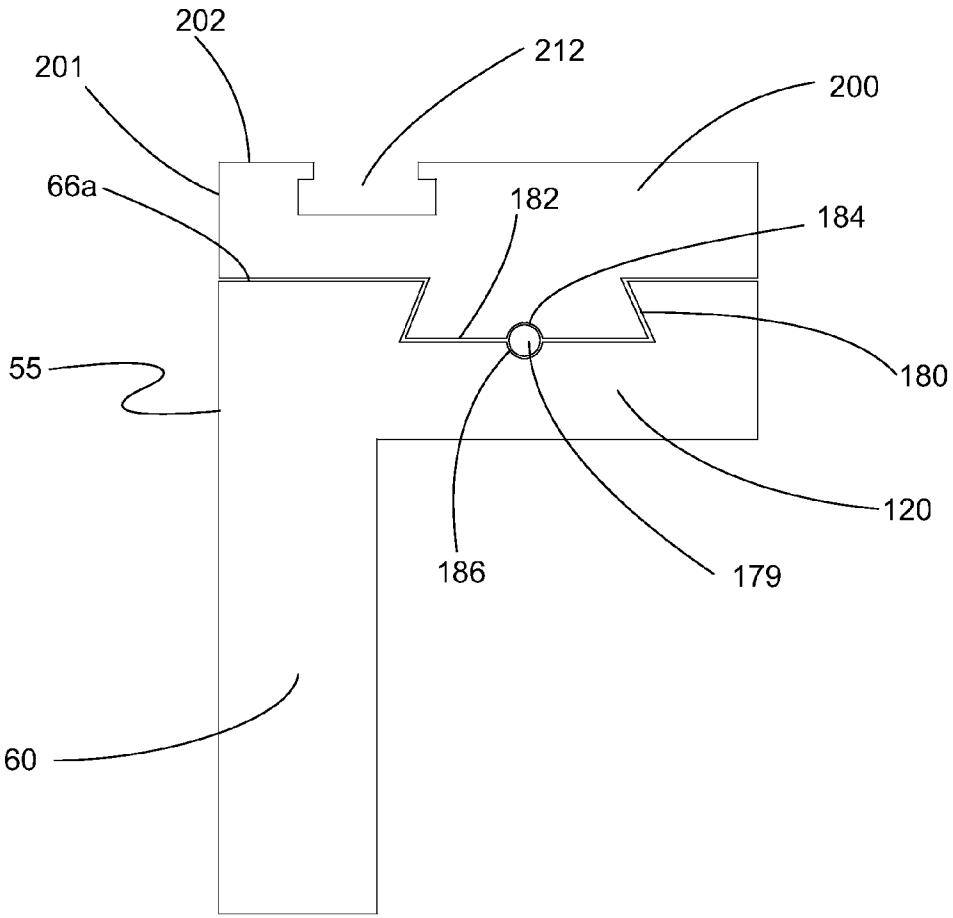
FIG. 6 is a cross-sectional view of another embodiment of the present invention.

Turning now to FIG. 6, there is shown another embodiment of slide mechanism 170 of the present invention. In this embodiment, slide mechanism 170 is a combination of a mortise 180 and tenon 182. Sliding member 200 features tenon 182 that slides along corresponding mortise 180 formed in the top surface 66*a* of longitudinal member 55, which has an inverted-L shape. In this embodiment, first side member 60 and bridge member 120 are unitary with mortise 180 formed in bridge member 120. It is contemplated that first side member 60 and bridge member 120 may be separate pieces joined to form an integral longitudinal member 55.

Sliding member 200 has tenon 182 with a cross-sectional shape corresponding to that of mortise 180. Mortise 180 has an optional groove 186 along all or part of its length to accommodate one or more roller(s) 179 (e.g., ball bearings). Tenon 182 has an optional groove 184 along all or part of its length to accommodate the one or more rollers 179 (e.g., a plurality of ball bearings). Sliding member 200 may have additional slots and rollers in other locations to facilitate and control movement of sliding member 200.

FIG. 6 also shows an embodiment of the present invention with an optional slot 212 formed into top surface 202 of sliding member 200. Slot 212 formed in top surface 202 of sliding member preferably extends parallel to existing rip fence 12 (not shown) along all or part of top surface 202 of sliding member 200. Slot 212 may be in addition to, or in place of, a separate mounting track 210 secured to top surface 202 of sliding member 200 as discussed below.

Figure 7:
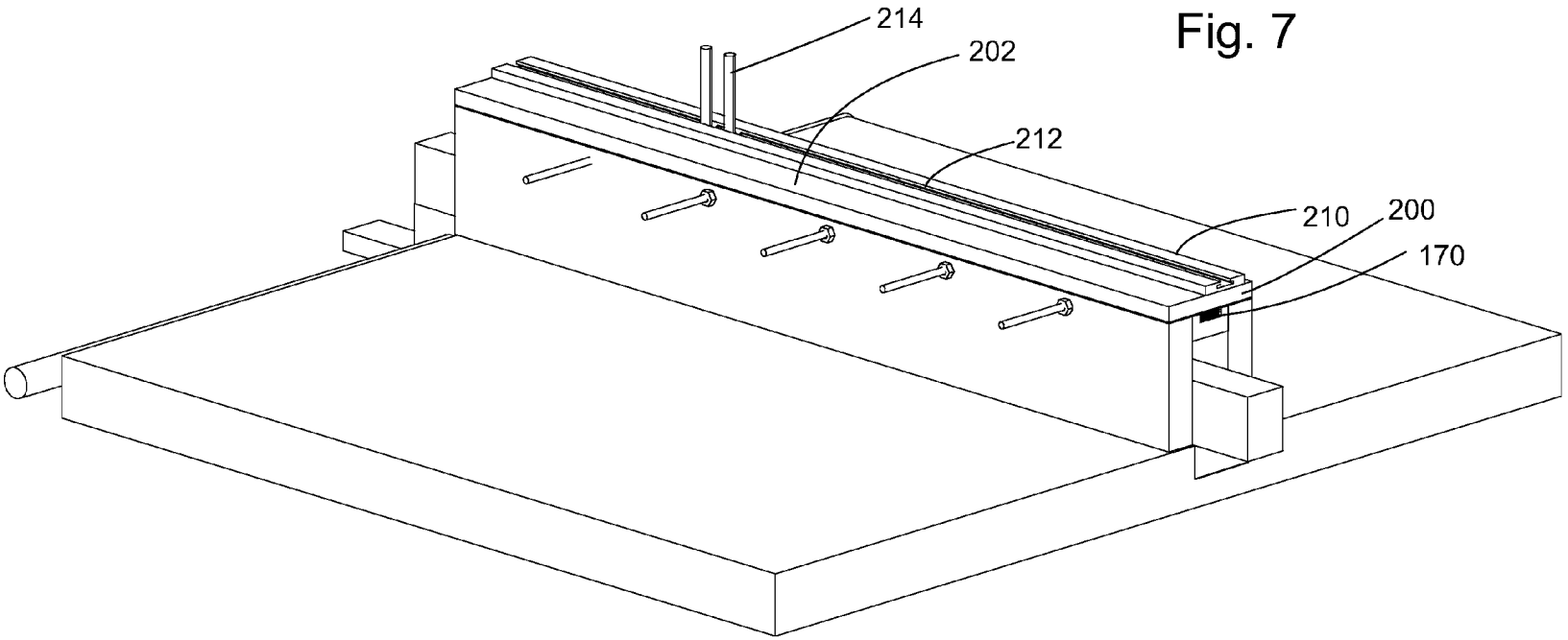
FIG. 7 is a rear perspective view of the fence attachment shown in FIG. 1.

Referring to FIG. 7, the sliding member 200 in some embodiments of the present invention has a separate mounting track 210 attached to top surface 202 of sliding member 200. Mounting track 210 may be attached with fasteners (not shown), adhesive, and the like. One embodiment of mounting track 210 has an inverted-T-shaped slot 212 along part or all of its length to accept heads of fasteners 214 (e.g., a bolt) or other mounting hardware. Fasteners 214 engage channel 212 and are tightened in place with nuts. Mounting track 210 may also be recessed or partially recessed within a channel (not shown) formed in top surface 202 of sliding member 200. FIGS. 7*a*-7*d* show cross-sectional profiles of alternate embodiments of mounting track 210.

Figure 7D:
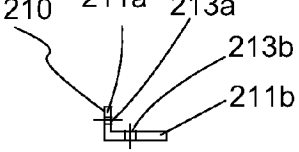
FIGS. 7*a*-7*d* are cross-sectional views of alternate embodiments of a mounting track for use on the sliding member with the present invention.
Figure 7C:
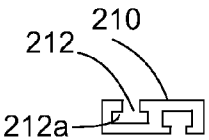
Figure 7B:
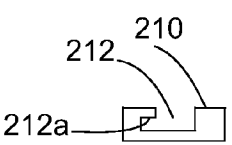
Figure 7A:
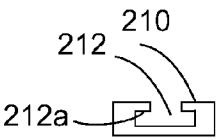

A head 215 of a fastener 214 fits within the channel 212 along mounting track 210, which is received and retained by longitudinal lip or flange 212*a*. Nuts secured to fasteners 214 are used to secure a shield 259, work tool accessory 250, or other item to fence attachment 50 (shown in FIGS. 8-10). The embodiment of mounting track 210 in FIG. 7*d* generally has an L-shaped cross section with one or more apertures 213*a*, 213*b* in first arm 211*a* and in second arm 211*b*. The apertures 213*a*, 213*b* are slots in some embodiments. In other embodiments, apertures 213*a*, 213*b* are a plurality of holes positioned along the length of mounting track 210. Apertures 213*b* in second arm 211*b* may be used with fasteners, for example, to secure mounting member 210 to sliding member 200. For example, a screw may extend through one or more of apertures 213*b* in second arm 211*b* and engage sliding member 200 for retaining mounting track 210 in place. Similarly, a user may use apertures 213*a* with fasteners, for example, to secure accessories or tools to first arm 211*a* of mounting track 210 as shown in FIG. 7*d*.

Figure 8:
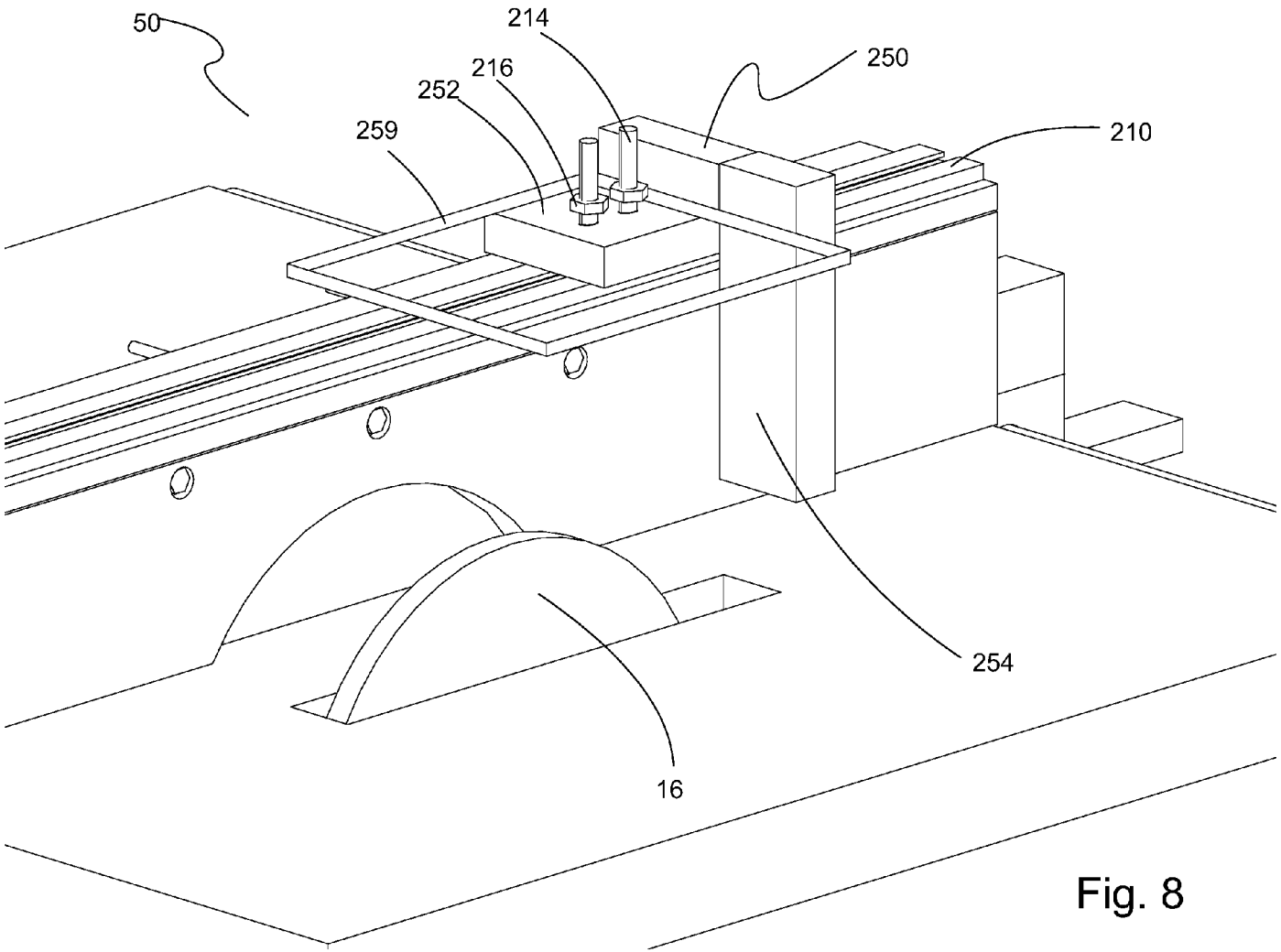
FIG. 8 is a perspective cutting-side view of one embodiment of the present invention showing an accessory secured to a mounting track of the slide member.

Turning now to FIG. 8, there is shown an embodiment of the present invention with an accessory 250 and shield 259 mounted to fence attachment 50. An accessory 250, such as a push bar, and/or a shield 259 may be secured individually or in combination to mounting track 210 with fasteners 214, 216. Fasteners 214 extend from mounting track 210 with nuts 216 to secure a frame 252 of accessory 250. Accessory 250 may be a push bar or other tool. Typically, a workpiece (not shown) is clamped to front side 254 of accessory 250 to be cut by cutting element 16.

Figure 9:
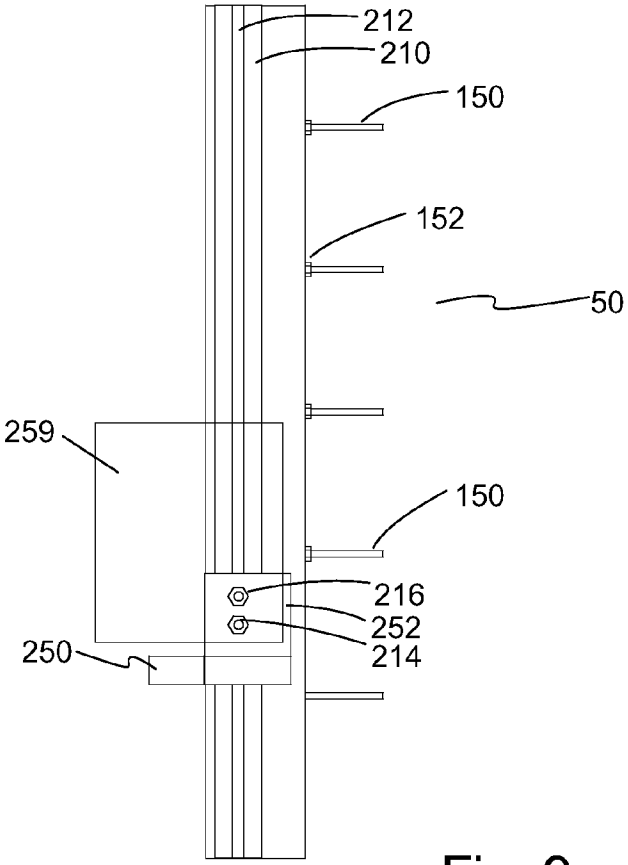
FIG. 9 is a top view of one embodiment of the present invention with the accessory shown in FIG. 8.

FIG. 9 illustrates a top view of fence attachment 50 with sliding member 200, mounting track 210, accessory 250, and shield 259. Shield 259 may be used to protect the user of power tool 10 from debris released from a workpiece during cutting. Fasteners 214 extend from mounting track 210 and have retaining nuts 216 tightened against shield 259 and frame 252 of accessory 250 to temporarily fix and secure the position of accessory 250 and optional shield 259 to mounting track 210.

Figure 10:
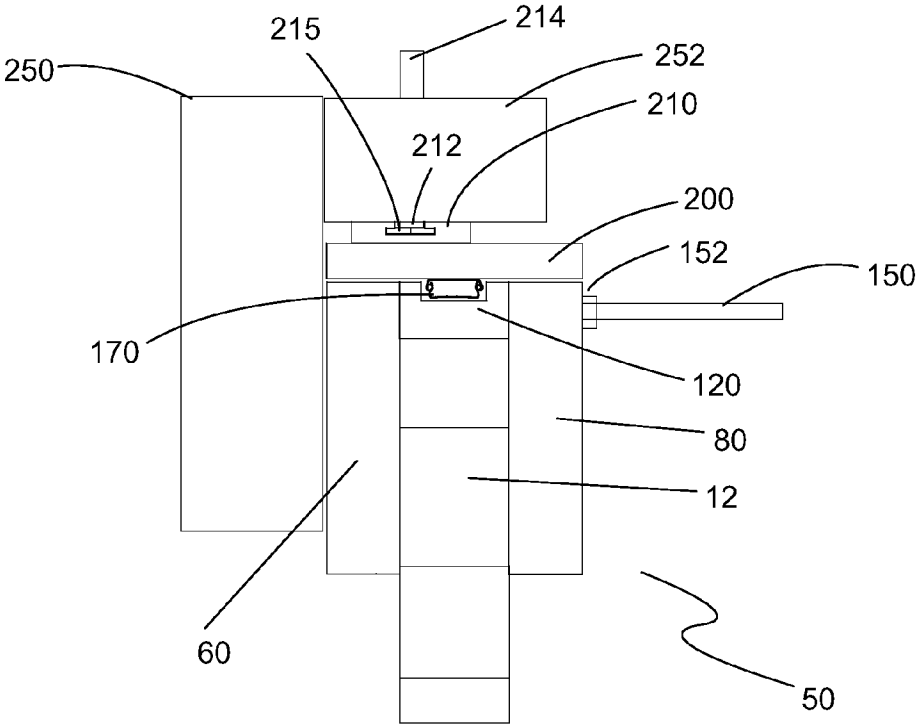
FIG. 10 is an end view of one embodiment of the present invention with the attached accessory and showing the fence attachment mounted to a fence.

FIG. 10 illustrates a front view of one embodiment of fence attachment 50 secured to existing rip fence 12. Fence attachment 50 has first longitudinal member 60, bridge member 120, second longitudinal member 80, sliding member 200, and slide mechanism 170. Heads 215 of fasteners 214 fit within slot 212 (more clearly shown in FIGS. 7*a*-7*c*) of mounting track 210 for securing accessory 250 to fence attachment 50. Securing elements 150 pass through longitudinal members 60, 80 and bridge member 120, extending to engage nut 152.

To use fence attachment 50, a user slips fence attachment 50 over an existing fence 12 of a power tool 10 and preferably secures its position by tightening nuts 152 of securing element 150 to create a clamping effect against fence 12 between first side member 60 and second side member 80. In other embodiments, a tight slip-fit with longitudinal member 55 may provide sufficient friction against existing rip fence 12 to hold fence attachment 50 in place without securing elements 150. Alternately, longitudinal member 55 may be secured to existing rip fence 12 using fasteners, brackets, clamps, and the like, and without second side member 80.

Although the present invention may optionally be attached by using fasteners such as bolts and screws directly through fence 12, the preferred methods of securing fence attachment 50 to rip fence 12 described above are designed to eliminate the need to modify existing fence 12 by, for example, drilling holes in fence 12. Fence attachment 50 is removable and transferable for use on a rip fence of another tool table 14.

The user attaches a push bar accessory 250 to the slot 212 in sliding member 200 and may optionally attach a shield 259. Once accessory 250 is securely attached to slide member 200, the user then preferably clamps a workpiece to the front side 254 of push bar accessory 250. The user turns on the power tool 10 and guides the workpiece toward and beyond the cutting element 16 by pushing the push bar attached to sliding member 200.

There are several advantages of the present invention. These include having the sliding member 200 move along the top surface 66*a* of longitudinal member 55 to avoid uneven wear patterns of prior art devices because the weight in the present invention is evenly distributed across the top surface 66*a* of longitudinal member 55. Having sliding member 200 move longitudinally along top surface 66*a* of longitudinal member 55 provides improved control over a workpiece and allows greater flexibility in the types of accessories 250 that may be attached to the fence attachment 50. Having sliding member 200 positioned on top surface 66*a* also further removes the user's hands from the cutting element 16 for improved safety. The present invention is particularly advantageous for making dovetail cuts in the ends of workpieces for joining the workpieces at a right angle such as when making a drawer. In that case, the workpiece is mounted to the front surface 154 of push bar accessory 250 in a fixed, vertical position that limits both upward and downward movement while permitting a smooth, sliding longitudinal feed into a cutting element 16.

Rather than being a separate fence attachment 50, features of the present invention may optionally be incorporated into a rip fence that replaces the existing rip fence 12 of a power tool 10.

Although the preferred embodiments of the present invention have been described herein, the above description is merely illustrative. Further modification of the invention herein disclosed will occur to those skilled in the respective arts and all such modifications are deemed to be within the scope of the invention as defined by the appended claims.

What is claimed is:

1. A fence attachment apparatus for a power tool table equipped with an existing rip fence having a cutting-side lateral surface, an outside lateral surface, and a top fence surface, the fence attachment apparatus comprising:

a longitudinal member with a longitudinal member top surface and comprising:

a first side member having a top surface, a bottom surface, a cutting-side lateral surface, and a fence-side lateral surface; a second side member, substantially parallel to the first side member, having a fence-side lateral surface: and a bridge member connected to the first side member adjacent the top surface and extending along a major portion of the first side member, the bridge member having a top bridge surface with a width that extends a pre-defined distance transversely from the first side member to a distal side away from the fence-side lateral surface of the first side member, wherein the longitudinal member top surface includes at least one surface selected from the group consisting of the top surface of the first side member and the top bridge surface;

wherein the longitudinal member substantially forms an inverted U-shape with a void to receive the existing rip fence, the fence-side lateral surfaces of the first and second side members respectively abut a major portion on the respective side of the existing rip fence and is adapted to be removably attached over the existing rip fence and the bridge member extending substantially horizontally over the top fence surface;

a sliding member in sliding engagement with the longitudinal member top surface, the sliding member having a top sliding surface and a bottom sliding surface; and a slide mechanism disposed between the bottom sliding surface of the sliding member and the longitudinal member top surface, the slide mechanism enabling longitudinal movement of the sliding member relative to the longitudinal member.

2. The fence attachment apparatus of claim 1, wherein the second side member is adapted to be adjustably connected adjacent to the distal side of the bridge member, wherein the void has an adjustable distance between the first side member and the second side member.

3. The fence attachment apparatus of claim 1, further comprising a sacrificial member on the cutting-side lateral surface of the first side member.

4. The fence attachment apparatus of claim 1, further comprising a sacrificial member on an opening portion of the bottom surface of the first side member.

5. The fence attachment apparatus of claim 1, wherein the first side member has a recess to accommodate a cutting element of the table power tool, the recess extending at least partially through the first side member from the cutting-side surface towards the fence-side surface.

6. The fence attachment apparatus of claim 1, wherein the slide mechanism is selected from the group consisting of a combination of a plurality of surfaces with a combined coefficient of friction less than 1.5 for longitudinal movement between the sliding member and the longitudinal member, a pair of mating sliding tracks each having a web and sidewalls, a tongue and groove combination, and a plurality of rollers disposed between the sliding member and the longitudinal member.

7. The fence attachment apparatus of claim 1, wherein one portion of the slide mechanism is on the longitudinal member top surface and a second portion of the slide mechanism is on the bottom sliding surface of the sliding member.

8. The fence attachment apparatus of claim 6, wherein at least one surface of the combination of a plurality of surfaces comprises polytetrafluoroethylene (PTFE).

9. The fence attachment apparatus of claim 6, wherein the coefficient of friction is 0.5 or less.

10. The fence attachment apparatus of claim 6, wherein the coefficient of friction is 0.1 or less.

11. The fence attachment apparatus of claim 1, further comprising a mounting member attached to the top sliding surface of the sliding member.

12. The fence attachment apparatus of claim 1, wherein the top sliding surface of the sliding member includes a longitudinal channel parallel and adjacent to the cutting-side lateral surface of the longitudinal member.

13. The fence attachment apparatus of claim 1, wherein the first side member and the bridge member comprise a single structure of unitary composition.

14. The fence attachment apparatus of claim 1, wherein the top bridge surface of the bridge member is coplanar with the top surface of the first side member.

15. The fence attachment apparatus of claim 1, further comprising a shield attached to the fence attachment.

16. The fence attachment apparatus of claim 2, further comprising a securing element configured to draw the first side member laterally towards the second side member.

17. The fence attachment apparatus of claim 1, further comprising a work tool accessory attached to the fence attachment.

* * * * *